US011435151B2

(12) United States Patent
Kincel et al.

(10) Patent No.: US 11,435,151 B2
(45) Date of Patent: Sep. 6, 2022

(54) MECHANICALLY COUPLED BUFFER AND CARRIER

(71) Applicant: BRAVO COMPANY MFG, INC., Hartland, WI (US)

(72) Inventors: Eric Stephen Kincel, Coeur d'Alene, ID (US); Jeffrey James O'Brien, Coeur d'Alene, ID (US)

(73) Assignee: BRAVO COMPANY MFG, INC., Hartland, WI (US)

( * ) Notice: Subject to any disclaimer, the term of this patent is extended or adjusted under 35 U.S.C. 154(b) by 0 days.

(21) Appl. No.: 17/153,567

(22) Filed: Jan. 20, 2021

(65) Prior Publication Data

US 2021/0222973 A1 Jul. 22, 2021

Related U.S. Application Data

(60) Provisional application No. 62/963,255, filed on Jan. 20, 2020.

(51) Int. Cl.
*F41A 3/84* (2006.01)

(52) U.S. Cl.
CPC ..... *F41A 3/84* (2013.01)

(58) Field of Classification Search
CPC ..... F41A 3/78; F41A 3/80; F41A 3/82; F41A 3/84; F41A 3/86
See application file for complete search history.

(56) References Cited

U.S. PATENT DOCUMENTS

| | | | | |
|---|---|---|---|---|
| 8,296,984 | B2 | 10/2012 | Kincel | |
| 8,307,750 | B2 * | 11/2012 | Vuksanovich | F41A 3/26 89/191.01 |
| 8,899,142 | B1 * | 12/2014 | Cassels | F41A 3/78 89/198 |
| 8,943,726 | B2 | 2/2015 | Kincel | |
| 9,341,437 | B1 | 5/2016 | Huang | |
| 9,915,492 | B2 | 3/2018 | Huang | |
| 10,323,891 | B1 * | 6/2019 | Zheng | F41A 3/88 |
| 10,415,907 | B1 | 9/2019 | Kincel et al. | |
| 10,458,732 | B2 | 10/2019 | Neitzling | |
| 10,690,425 | B2 * | 6/2020 | Cassels | F41A 3/26 |
| 10,704,848 | B1 * | 7/2020 | Zeider | F41A 3/84 |
| 10,816,287 | B1 * | 10/2020 | Russo | F41A 3/84 |
| 2012/0152105 | A1 * | 6/2012 | Gomez | F41A 5/20 89/191.01 |

(Continued)

OTHER PUBLICATIONS

Image of a bolt carrier group with a piston fixed to the carrier, retrieved from <https://vtsupply-com.3dcartstores.com/assets/images/products/mk1_ps_splash22.jpg> image publicly available at least as early as Dec. 31, 2019.

(Continued)

*Primary Examiner* — Joshua E Freeman
(74) *Attorney, Agent, or Firm* — Michael Best & Friedrich LLP

(57) ABSTRACT

A mechanically coupled buffer and carrier for a firearm includes an interlocking feature on each of the buffer and carrier such that the buffer and carrier are mechanically coupled to prevent carrier tilt and buffer bounce. The interlocking features are brought together to mechanically couple the buffer and carrier during the assembly process of the firearm as the upper receiver is mounted to the lower receiver.

19 Claims, 9 Drawing Sheets

(56) References Cited

U.S. PATENT DOCUMENTS

| | | | | |
|---|---|---|---|---|
| 2014/0041518 | A1* | 2/2014 | Neitzling | F41A 3/78 89/191.01 |
| 2014/0059909 | A1* | 3/2014 | Caudle | F41A 3/84 42/1.06 |
| 2014/0075798 | A1 | 3/2014 | Kincel | |
| 2018/0328682 | A1* | 11/2018 | Myers | F41A 3/84 |
| 2019/0293379 | A1* | 9/2019 | Taylor | F41A 25/12 |
| 2020/0096268 | A1* | 3/2020 | Lage | F41A 19/12 |
| 2020/0182569 | A1* | 6/2020 | Underwood | F41A 3/84 |
| 2021/0003357 | A1* | 1/2021 | Durham, III | F41A 3/82 |
| 2021/0156633 | A1* | 5/2021 | Durham, III | F41A 3/70 |

OTHER PUBLICATIONS

Image of two bolt carrier groups, retrieved from <https://files.osgnetworks.tv/11/files/2010/09/st_pistondrives_200910-c.jpg> image publicly availble at least as early as Dec. 31, 2019.

Image of a reloading case holder, retrieved from <http://www.mssblog.com/wp-content/uploads/2016/12/center3.jpg> image publicly available at least as early as Dec. 31, 2019.

DSArms, "DSA AR15 Bufferloc Kit—Recoil & Operation Enhancement Upgrade," <https://www.dsarms.com/p-14112-dsa-ar15-bufferloc-kit-recoil-operation-enhancement-upgrade.aspx> web page publicly available at least as early as Dec. 31, 2019.

Armament USA, "L.A.R.B. Mod 2," <https://armamentusa.com/product/larb/> web page publicly available at least as early as Dec. 31, 2019.

Heavy Buffers, "Anti-Tilt Buffers for Piston-Operated ARs," <https://heavybuffers.com/antitilt223rifle.html> web page publicly available at least as early as Dec. 31, 2019.

NEMO Arms, "Large Frame Recoil Reduction Bolt Carrier Group and Buffer Kit," <https://nemoarms.com/product/large-frame-recoil-reduction-bolt-carrier-group-and-buffer-kit/> web page publicly available at least as early as Jan. 20, 2020.

* cited by examiner

MECHANICALLY COUPLED BUFFER AND CARRIER

CROSS-REFERENCE TO RELATED APPLICATIONS

This application claims priority to U.S. Provisional Patent Application No. 62/963,255, filed Jan. 20, 2020, the entire content of which is incorporated herein by reference.

BACKGROUND

The present invention relates to a buffer and bolt carrier for a firearm. The buffer and bolt carrier are designed to interlock to maintain the two components in longitudinal alignment and to reduce or eliminate bounce between the two components.

SUMMARY

The invention provides, in one aspect, a bolt carrier and buffer assembly including a bolt carrier having a carrier interlocking feature and a buffer having a buffer interlocking feature that mates with the carrier interlocking feature to form a carrier-buffer assembly. The carrier-buffer assembly defines a longitudinal axis, and mating the buffer interlocking feature with the carrier interlocking feature prevents relative longitudinal movement between the bolt carrier and buffer.

The invention provides, in another aspect, a firearm including an upper receiver, a buttstock coupled to the upper receiver, a bolt carrier received for reciprocating motion in the upper receiver, the bolt carrier including a carrier interlocking feature, and a buffer extending into the buttstock. The buffer includes a buffer interlocking feature configured to mate with the carrier interlocking feature to form a carrier-buffer assembly. The carrier-buffer assembly defines a longitudinal axis. Mating the buffer interlocking feature with the carrier interlocking feature prevents relative longitudinal movement between the bolt carrier and the buffer, and disengaging the buffer interlocking feature and the carrier interlocking feature permits the bolt carrier and the buffer to be separated.

The invention provides, in another aspect, a method of mechanically interlocking a buffer and a bolt carrier of a firearm having an upper receiver and a buttstock. The method includes positioning the bolt carrier such that a carrier interlocking feature of the bolt carrier is at a rear end of the upper receiver, pivoting the upper receiver relative to the buttstock to align a buffer interlocking feature at a front end of the buffer with the carrier interlocking feature, and moving a head of the buffer interlocking feature into a mouth of the carrier interlocking feature.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
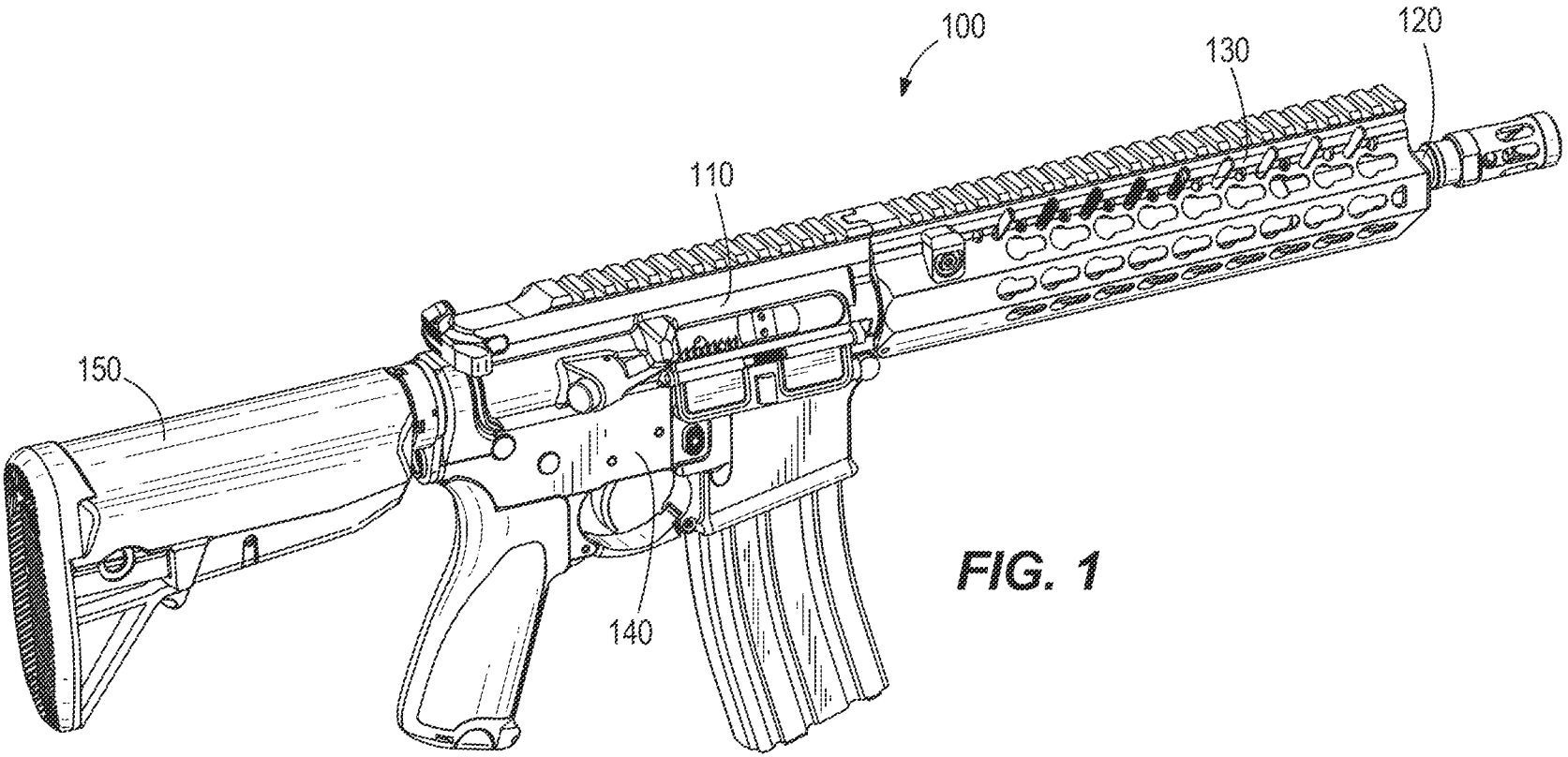
FIG. 1 illustrates an exemplary firearm including an embodiment of the present invention.

FIG. 1 illustrates an exemplary firearm 100 which may embody the present invention. For the purposes of this disclosure, directional and relative terms such as front, forward, rear, and rearward are used from the perspective of a firearm operator using the firearm 100 in its intended way. The illustrated firearm 100 is an AR-15 rifle and includes an upper receiver 110 to which a barrel 120, hand guard 130, lower receiver 140, and buttstock 150 are mounted. The components are generally conventional and well known.

Figure 2:
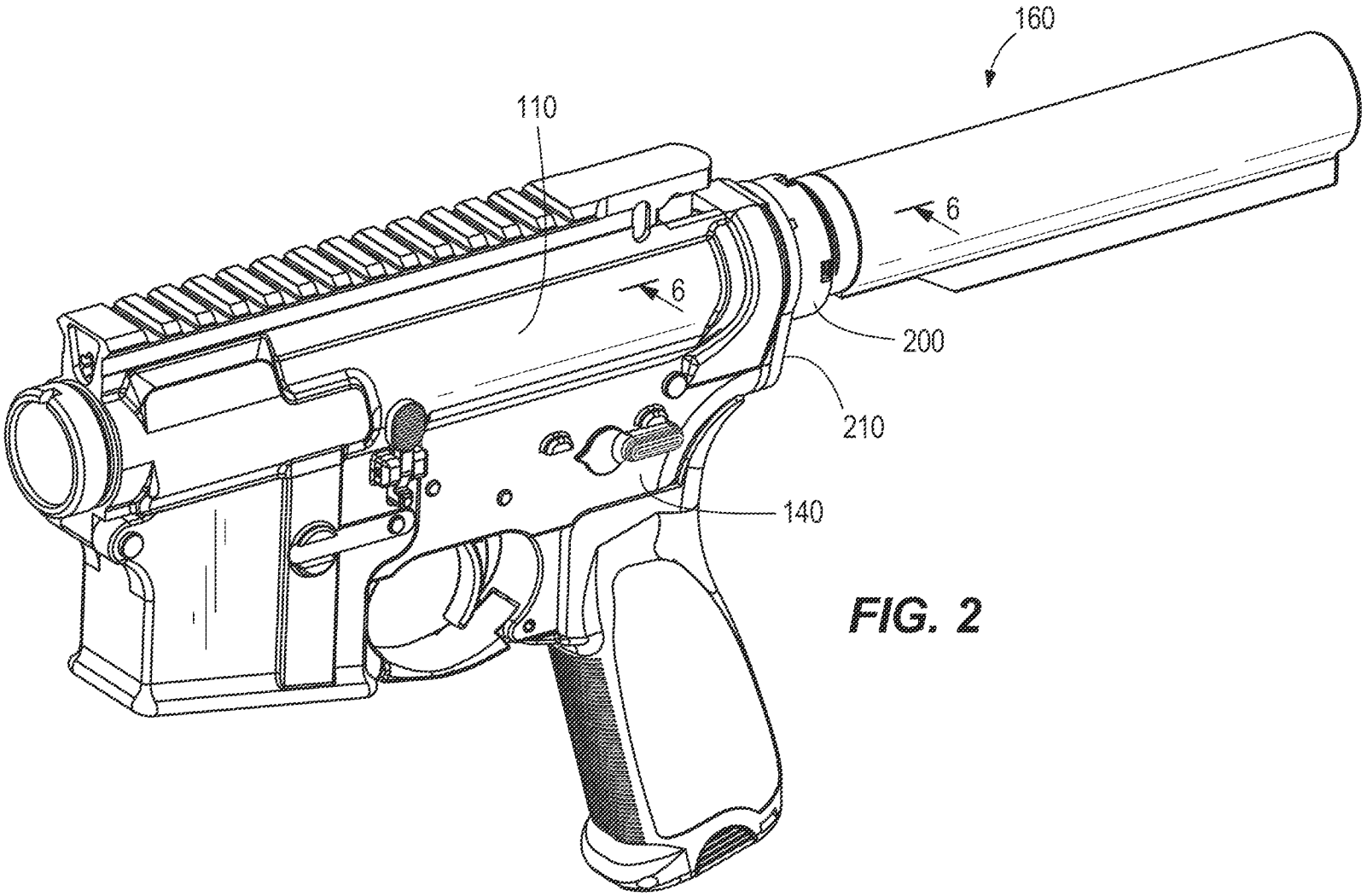
FIG. 2 is a perspective view of the upper receiver and lower receiver of the firearm.

FIG. 2 illustrates the upper and lower receivers 110, 140 in an assembled condition, and a buffer assembly 160 mounted to the lower receiver 140 and extending rearwardly. When the firearm 100 is fully assembled, the buffer assembly 160 extends into the buttstock 150 (FIG. 1).

Figure 3:
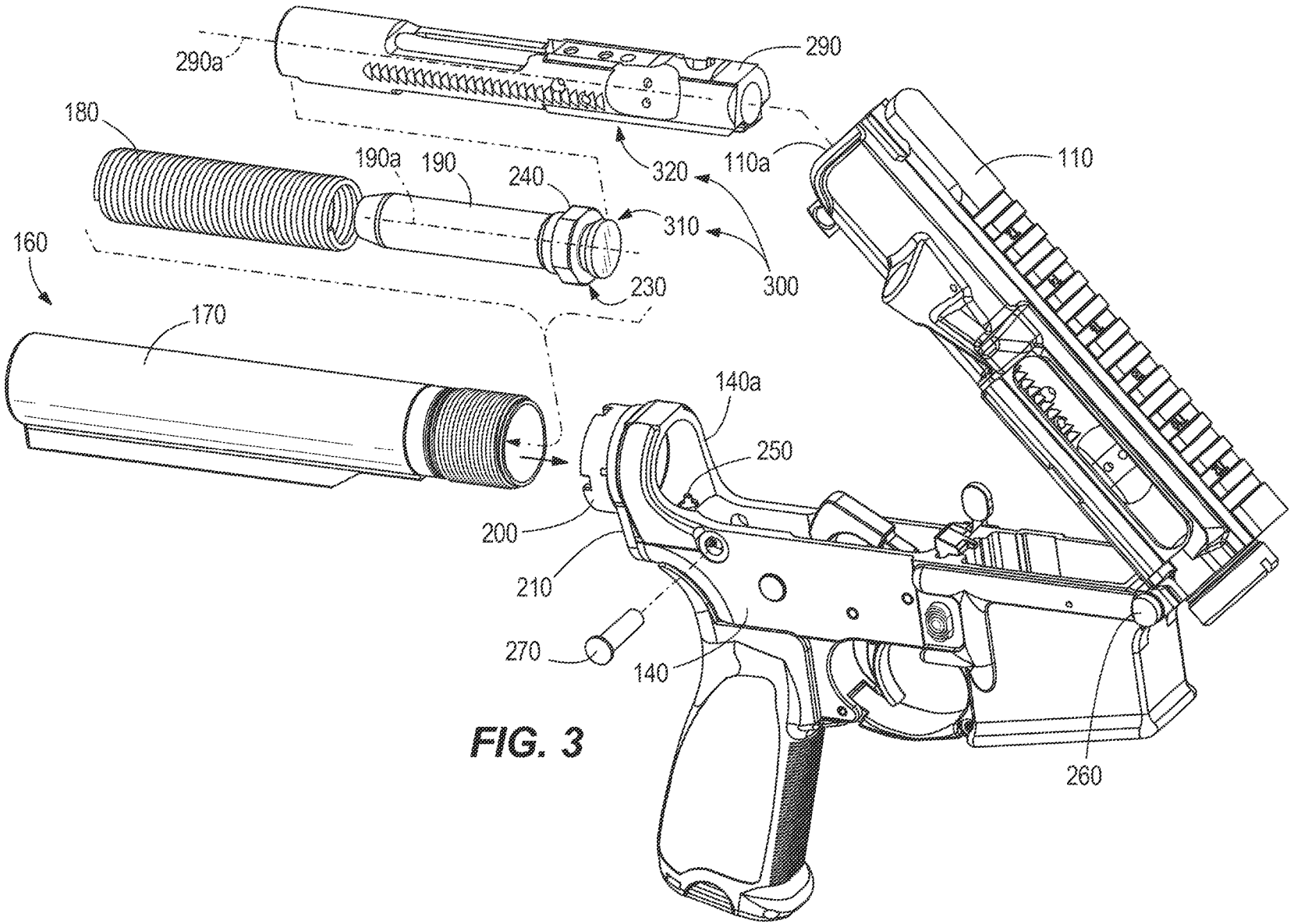
FIG. 3 is an exploded view of a step of mechanically coupling the upper and lower receivers.

As seen in FIG. 3, the buffer assembly 160 includes a buffer tube 170, an action spring 180, and a buffer 190. The buffer tube 170 is threadedly mounted to the rear of the lower receiver 140 by way of a castle nut 200 and a receiver end plate 210. The action spring 180 is a coil compression spring. The buffer 190 defines a longitudinal buffer axis 190*a* and includes an end cap 230 at its forward end. The end cap 230 defines a rearwardly-facing shoulder 240. During assembly, the action spring 180 and the buffer 190 are inserted into the buffer tube 170. As assembled, coils of the action spring 180 surround the main body of the buffer 190, a rear end of the action spring 180 bottoms out in the buffer tube 170, and a forward end of the action spring 180 abuts the rearwardly-facing shoulder 240 of the end cap 230.

The action spring 180 (not seen, inside the buffer tube 170) is deflected to some degree during assembly to generate a forward biasing force against the rearwardly-facing shoulder 240 (not seen, inside the buffer tube 170) of the end cap 230. A spring-biased buffer retaining pin 250 in the lower receiver 140 can be depressed into the lower receiver 140 while inserting the action spring 180 and buffer 190 into the buffer tube 170. While holding the buffer 190 in the buffer tube 170 against the biasing force of the action spring 180, the buffer retaining pin 250 can be released to pop up in front of the buffer end cap 230 to prevent the buffer 190 from being pushed out of the buffer tube 170 by the action spring 180.

Figure 4:
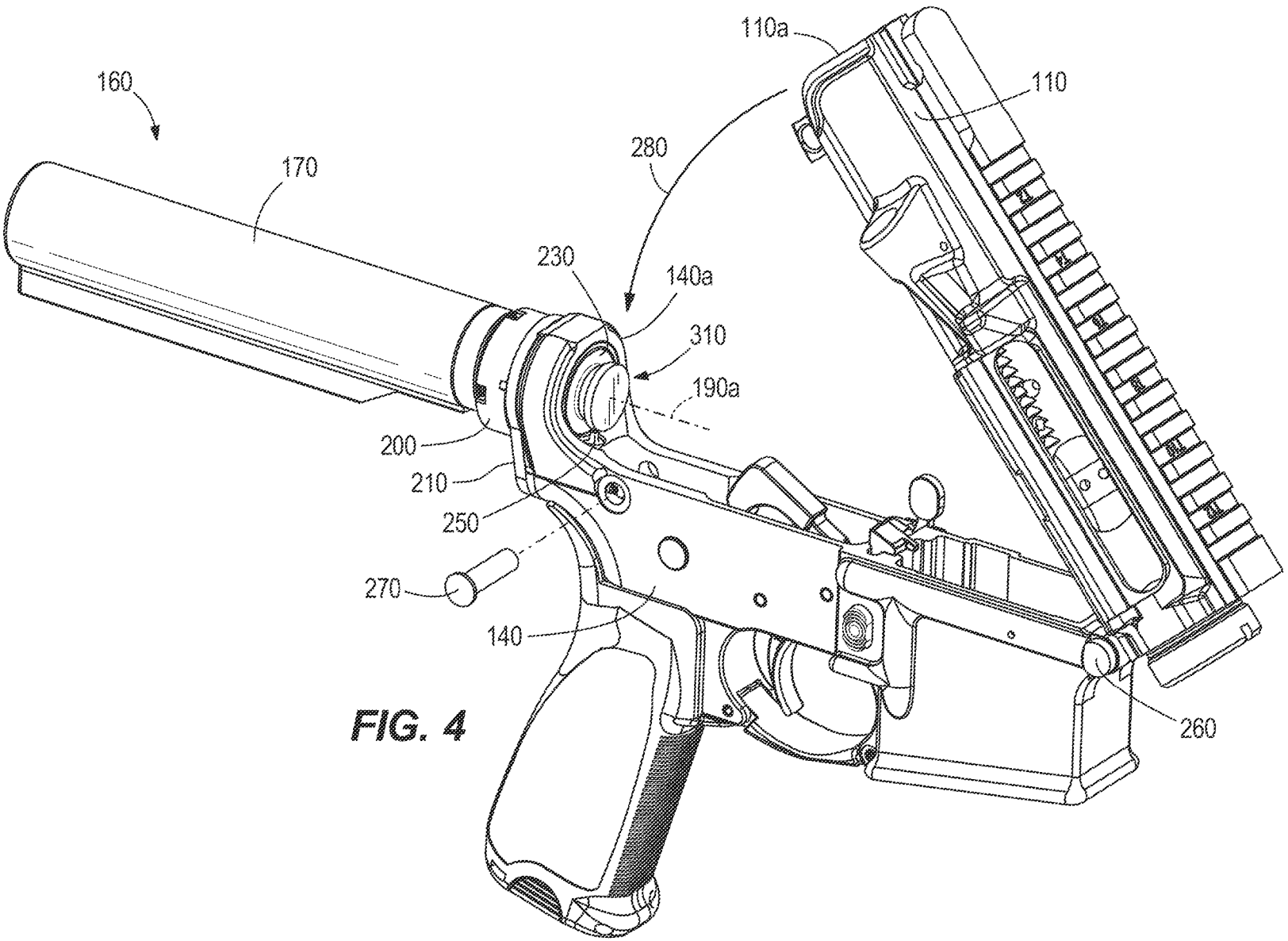
FIG. 4 is an exploded view of another step subsequent to FIG. 3.

Referring to FIG. 4, with the action spring 180 and buffer 190 secured in the buffer tube 170, the upper receiver 110 can be secured in an operable position on the lower receiver 140. The upper receiver 110 is secured to the lower receiver 140 with front and rear receiver pins 260, 270 which create respective front and rear hinge joints. Typically, the front of the upper receiver 110 is secured to the lower receiver 140 with the front receiver pin 260, then the upper receiver 110 is hinged down about the front hinge joint as indicated in FIG. 4 with arrow 280, and then the upper receiver 110 is secured to the lower receiver 140 with the rear receiver pin 270. The upper receiver has a rearwardly-facing upper mating surface 110*a* and the lower receiver has a forwardly-facing lower mating surface 140*a*. When assembled, the upper mating surface 110*a* and the lower mating surface 140*a* are positioned adjacent each other.

Referring again to FIG. 3, a bolt carrier 290 is received for reciprocating motion in the upper receiver 140. The bolt carrier 290 has a longitudinal carrier axis 290*a*. The bolt carrier 290 collects a bolt that has been fed into the upper receiver 110 and moves the bolt into battery position where it is read to be fired. When a bolt is fired, expanding gases from the barrel 120 are used as a motive force (e.g., by direct gas impingement on the bolt carrier, or to drive a piston which in turn strikes the bolt carrier) to drive the bolt carrier 290 rearwardly in the upper receiver 110. As the bolt carrier 290 moves rearwardly, a shell of the spent bolt is ejected through a side door in the upper receiver 110 so that a new bolt can be loaded. The bolt carrier 290 drives the buffer 190 rearward in the buffer tube 170. The action spring 180 absorbs the energy of the rearwardly driven bolt carrier 290 and buffer 190. The buffer 190 strikes the end of the buffer tube 170 where rearward motion of the buffer 190 and bolt carrier 290 is arrested. Then the action spring 180 drives the buffer 190 and bolt carrier 290 forward to pick up the next bolt and secure it in the battery position.

The present invention provides a mechanical coupling 300 or interlock between the buffer 190 and bolt carrier 290, and the remainder of this disclosure will discuss features and strategies related to the mechanical coupling. The mechanical coupling 300 comprises a buffer interlock feature 310 and a carrier interlock feature 320 which will be discussed in more detail below.

As used herein with respect to the buffer 190 and bolt carrier 290, the terms "mechanical coupling," "mechanical interlock," and "interlock" are nouns having the same meaning of a joint through which the two components are physically connected as an assembly, which is distinguished from the two components merely being biased against each other and having adjacent surfaces. The terms "mechanically coupling," "interlocking," and "mechanically interlocking" are verbs having the same meaning of the act of physically connecting or joining the buffer 190 and bolt carrier 290. There are two primary phenomena or problems that are mitigated by mechanically coupling the buffer 190 and bolt carrier 290: carrier tilt and buffer bounce. To be "mechanically coupled" within the meaning of this disclosure, the buffer 190 and bolt carrier 290 must be physically connected in a way that reduces or eliminates one or both problems.

Carrier tilt occurs when the motive force is unevenly applied to the bolt carrier 290 such that one side, usually the top, of the bolt carrier 290 experiences higher rearward thrust than the opposite side. The most efficient and desirable operation of the buffer 190 and bolt carrier 290 occurs when the buffer axis 190*a* and the carrier axis 290*a* are parallel or collinear. When carrier tilt occurs, the carrier axis 290*a* tips with respect to the buffer axis 190*a* such that the carrier axis 290*a* is no longer parallel or collinear with the buffer axis 190*a*. Forces which cause carrier tilt may be referred to as off-axis forces. Carrier tilt most commonly happens with piston-operated AR-type platforms, and among piston-operated systems it most commonly occurs in so-called short-stroke systems. In a piston-operated system, a piston is driven rearwardly by the motive force (barrel gases) and strikes (directly or indirectly through a transfer rod) a carrier tower or block which is usually on the top of the bolt carrier 290. The sudden rearward strike to the tower is an off-axis force that causes the bolt carrier 290 to pivot about a horizontal axis so that the front end of the bolt carrier 290 bucks upwardly and the rear end of the bolt carrier 290 drops downwardly. With the bolt carrier 290 tilted or tipped this way, rearward movement of the bolt carrier 290 will often cause the rear bottom edge of the bolt carrier 290 to scrape against an inner surface of the upper receiver 110. More specifically, in most AR-15 models, the rear bottom edge of the bolt carrier 290 scrapes against a portion of the 110 upper receiver called a receiver extension which extends under the forward end of the buffer 190. Such scraping causes loss of energy, vibrations, and off-axis forces that can reduce shooting accuracy and comfort for the operator.

Buffer bounce occurs the moment the bolt carrier 290 is driven rearwardly by the motive force, when the rearward end of the bolt carrier 290 strikes or applies a sudden rearward force against the forward end of the buffer 190. The buffer 190 is jolted into motion with the initial result of bouncing off the rear end of the bolt carrier 290. In other words, the buffer 190 jumps rearwardly off the bolt carrier 290 when the buffer is initially struck or pushed rearwardly by the bolt carrier 290. This buffer bounce causes momentary separation between the bolt carrier 290 and the buffer 190 which is rapidly overcome when the bolt carrier 290 catches up with the buffer 190 and contacts the buffer 190 again. Even when buffer bounce is slight (0.100"+–) it can cause inconsistent carrier velocities which affect rate of fire, accuracy, and reliability. What's more, the frequency and severity of buffer bounce is not consistent enough in most firearms to invite a reliable solution until the present invention.

As mentioned above, the buffer 190 and carrier 290 are mechanically coupled by way of a mechanical coupling 300 comprising a buffer interlock feature 310 and a carrier interlock feature 320. The buffer interlock feature 310 is at the forward end of the buffer 190 and a carrier interlock feature 320 is at the rear end of the bolt carrier 290. The mechanical coupling 300 illustrated in FIGS. 3-6 is a first version or configuration of a mechanical coupling according to the present invention. Some additional versions of a mechanical coupling are illustrated in FIGS. 7-10 and will be described in more detail below. The invention is not limited to the illustrated mechanical coupling examples, however, and the invention can take the form of substantially any physical connection between the buffer 190 and bolt carrier 290 that reduces or eliminates at least one of carrier tilt and buffer bounce.

Figure 5:
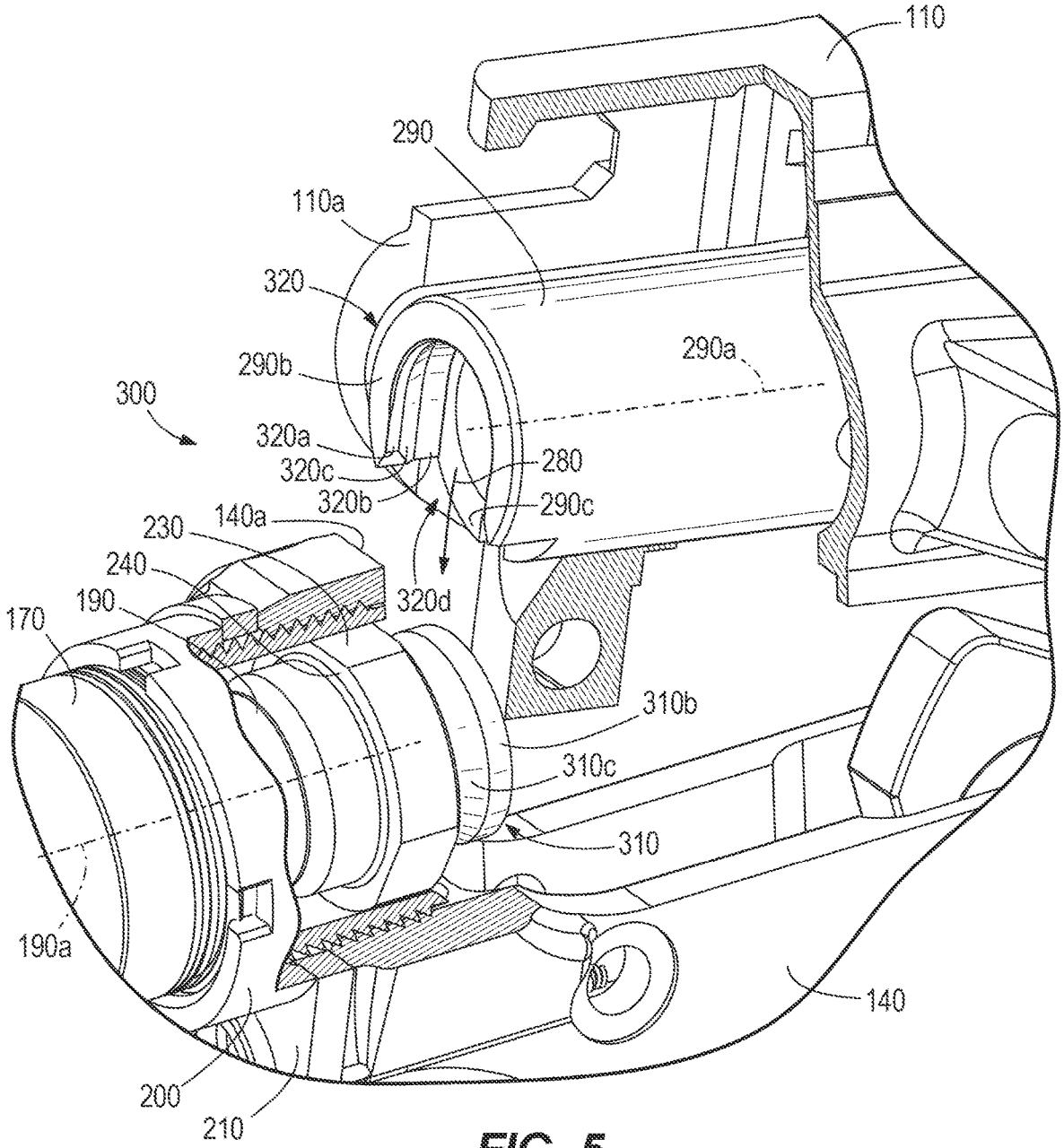
FIG. 5 is an enlarged partly cut-away view of the upper and lower receivers during a step of mechanically coupling.
Figure 6:
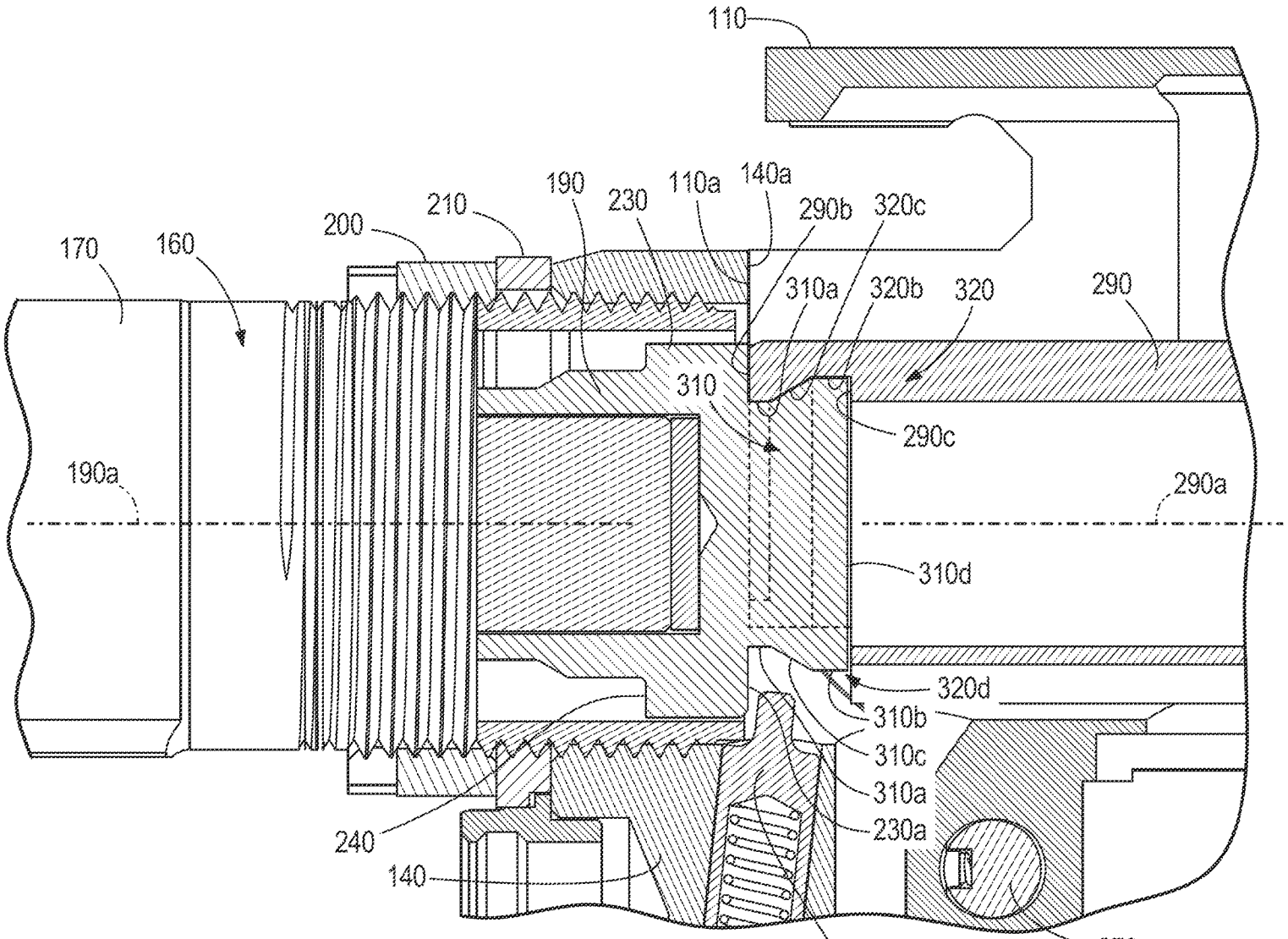
FIG. 6 is a cross-sectional view taken along line 6-6- in FIG. 2.

The details of the first version of the mechanical coupling 300 are best seen in the enlarged views of FIGS. 5 and 6. The buffer interlock feature 310 includes a neck 310*a* (FIG. 6 only), button head 310*b*, and shoulder 310*c* integrally formed with the buffer end cap 230. The neck 310*a* is a reduced diameter cylindrical section that extends rearwardly from a hex head of the buffer end cap 230. The hex head defines a flat forwardly-facing buffer cap surface 230*a* around the base of the neck 310*a*. In known buffer end caps, the hex head is the forwardmost portion of the buffer and provides flats in the shape of a hex head for tightening and loosening the end cap 230 on to the main buffer body with a wrench. In the present invention, the buffer interlock feature 310 extends forward of the hex head (i.e., forward of the buffer cap surface 230*a*). The button head 310*b* is a larger diameter disc at the end of the neck 310*a*, defining a flat forwardly-facing button end surface 310*d*. The diameter of the button head 310*b* is larger than the diameter of the neck 310*a* but not wider than the hex head of the buffer end cap 230. The shoulder 310*c* is formed in the transition between the neck 310*a* and button head 310*b*. The shoulder 310*c* is beveled or angled a desired angle in the illustrated embodiment but may be a ninety-degree corner between the neck 310*a* and button head 310*b* in other embodiments if materials and stresses permit. The shoulder 310*c* can be thought of as a rearward-facing underside of the button head 310*b*.

The carrier interlock feature 320 takes the form of a horseshoe-shaped throat 320*a*, undercut groove 320*b*, and forwardly-facing bearing surface 320*c* formed in the rear end of the bolt carrier 290. The horseshoe shape is best seen in FIG. 5. The rear end of the bolt carrier 290 defines a rearwardly-facing horseshoe-shaped carrier end surface 290*b*. The bolt carrier 290 also defines a rearwardly-facing groove bottom surface 290*c* at the forward end of the undercut groove 320*b*. The carrier interlock feature 320 is formed in the sides and top of the rear end of the bolt carrier 290, but is open on the bottom, giving rise to the horseshoe shape referred to above. The horseshoe-shaped carrier interlock feature 320 can be said to have side portions, a top portion, and a mouth 320*d* defining the bottom opening. The throat 320*a*, undercut groove 320*b*, and bearing surface 320*c* of the carrier interlock feature 320 mirror the respective neck 310*a*, button head 310*b*, and shoulder 310*c* of the buffer interlock feature 310 so that the neck 310*a* and button head 310*b* fit snugly within the throat 320*a* and undercut groove 320*b* with the rearwardly-facing shoulder 310*c* abutting the forwardly-facing bearing surface 320*c*. Additionally, the forwardly-facing buffer cap surface 230*a* abuts the rearwardly-facing carrier end surface 290*b* and the forwardly-facing button end surface 310*d* abuts the rearwardly-facing groove bottom surface 290*c*. In summary, the throat 320*a* is of the same diameter and longitudinal thickness as the diameter and longitudinal length of the neck 310*a*, the undercut groove 320*b* describes an arc of the same diameter and depth (longitudinal thickness) as the diameter and thickness of the button head 310*b*, and the bearing surface 320*c* has the same thickness and angle as the shoulder 310*c*.

The mouth 320*d* of the carrier interlock feature 320 (i.e., the throat 320*a*, undercut groove 320*b*, bearing surface 320*c*) is of equal width to the corresponding features (i.e., the neck 310*a*, button head 310*b*, and shoulder 310*c*) of the buffer interlock feature so 310 that the buffer interlock feature can be radially moved into the carrier interlock feature 320 through the mouth 320*d*. Consequently, the buffer interlock feature 310 and the carrier interlock feature 320 may be mechanically coupled through relative radial (i.e., perpendicular to the buffer axis) movement between the buffer 190 and bolt carrier 290. The relative radial movement may comprise one of the features moving radially toward the other feature or the features being simultaneously moved radially toward each other.

The snug fit between the buffer interlock feature 310 and the carrier interlock feature 320 mechanically couples the interlock features 310, 320 to resist relative longitudinal movement through any or all of the following: engagement of the rearward-facing shoulder 310*c* and the forward-facing bearing surface 320*c*; engagement of the forwardly-facing buffer cap surface 230*a* and the rearwardly-facing carrier end surface 290*b*; and engagement of the forwardly-facing button end surface 310*d* and the rearwardly-facing groove bottom surface 290*c*.

The snug fit also mechanically couples the interlock features 310, 320 to maintain the buffer axis 190*a* and carrier axis 290*a* parallel or collinear. In the illustrated embodiment, the buffer axis 190*a* and carrier axis 290*a* are collinear. Carrier tilt is countered by combinations of the following: engagement of the rearward-facing shoulder 310*c* and the forward-facing bearing surface 320*c*; engagement of the forwardly-facing buffer cap surface 230*a* and the rearwardly-facing carrier end surface 290*b*; and engagement of the forwardly-facing button end surface 310*d* and the rearwardly-facing groove bottom surface 290*c*. Engagement of these surfaces counteracts moments on the bolt carrier 290 arising from off-axis forces.

Mechanical coupling of the buffer interlock feature 310 and the carrier interlock feature 320, causes the buffer 190 and bolt carrier 290 to behave as a single component rather that two separate components. Thus, the buffer 190 does not bounce off the bolt carrier 290 due to inertia and the bolt carrier 290 does not tilt with respect to the buffer 190. An off-axis force such as a piston or transfer rod strike is borne by the buffer 190 and the bolt carrier 290 as a combined unit, which is a longer and more massive combined component than the bolt carrier 290 alone. The mechanically coupled buffer 190 and bolt carrier 290 absorb and resist tilt better than the bolt carrier 290 can alone.

FIGS. 4-6 illustrate a method or process of mechanically coupling the buffer 190 and the bolt carrier 290. In FIG. 4, the buffer 190 and action spring 180 are inserted into the buffer tube 170 and retained in the buffer tube 170 with the buffer retaining pin 250. The buffer cap surface 230*a* (FIG. 6) is flush with the forwardly-facing lower mating surface 140*a* of the lower receiver 140 and the buffer interlock feature 310 extends forwardly in front of the lower mating surface 140*a*. The bolt carrier 290 is positioned in the upper receiver 110 with the carrier end surface 290*b* flush with the upper mating surface 110*a* of the upper receiver 110. As such, the carrier interlock feature 320 is within the rear end of the upper receiver 110.

As seen in FIGS. 4 and 5, the upper receiver 110 is pivoted downward with respect to the lower receiver 140 (and the buttstock 150; FIG. 1) about the front receiver pin 260 in the direction of arrow 280. As seen in FIG. 6, the downward motion of the upper receiver 110 aligns the interlock features 310, 330. Continued motion of the upper receiver 110 positions the upper mating surface 110*a* adjacent and lower mating surface 140*a* and moves the buffer interlock feature 310 into the carrier interlock feature 320 through the mouth 320*d* of the carrier interlock feature 320. As such, the buffer 190 and bolt carrier 290 are automatically mechanically coupled with the mechanical coupling 300 as the upper receiver 110 is installed on the lower receiver 140.

FIGS. 7-11 illustrate four variations on the mechanical coupling described above. Because the basic construction of the buffer 190, bolt carrier 290, and mechanical interlocks are the same as discussed above in FIGS. 3-6, the same reference numbers will be used where applicable and new reference numbers will be used to indicate new components or features.

Figure 7:
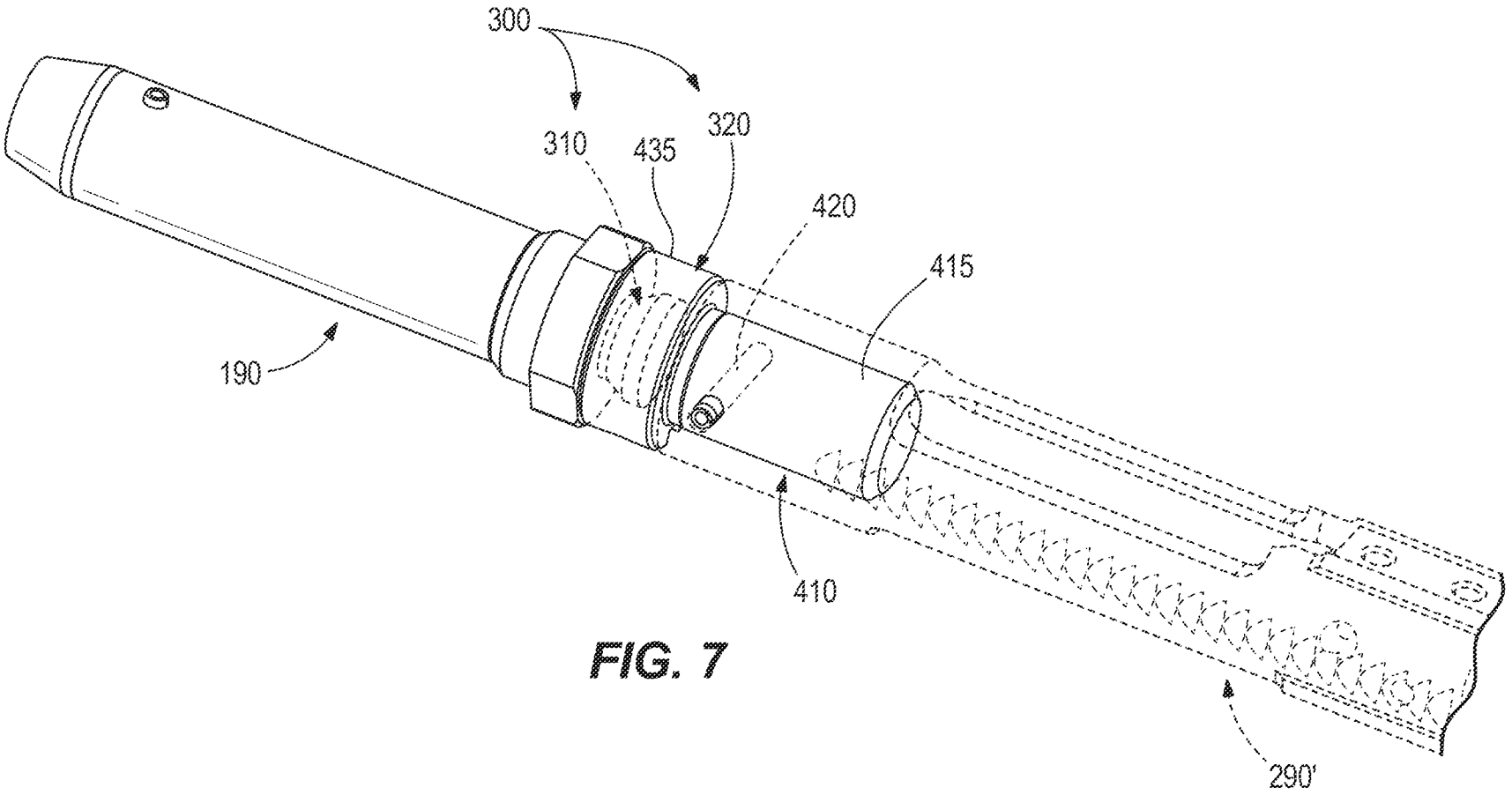
FIG. 7 is a perspective view of a second configuration a mechanical coupling between the buffer and bolt carrier.
Figure 8:
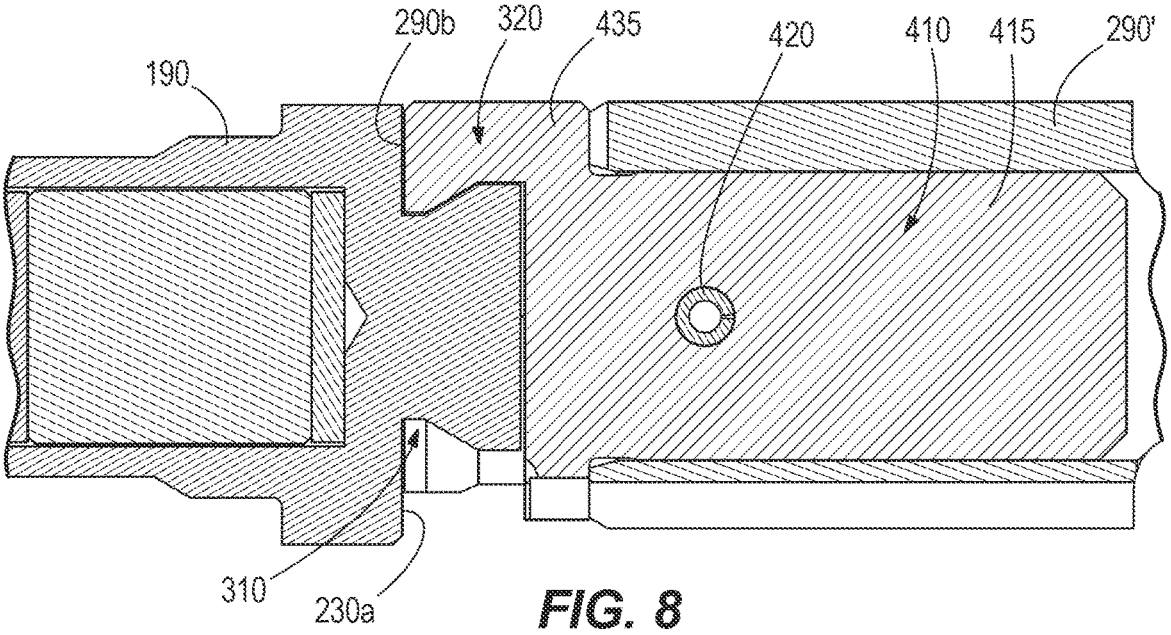
FIG. 8 is a cross-sectional view of the mechanical coupling of FIG. 7.

FIGS. 7 and 8 illustrate a second version of the mechanical coupling 300 in which the carrier interlock feature 320 is formed in a carrier extension 410 or "slug" that is separate from a modified bolt carrier 290'. The carrier extension 410 includes an elongated stem 415 and a coupler 435 which are integrally formed with each other. The elongated stem 415 extends into the hollow rear end of the modified bolt carrier 290' and is pinned to the modified bolt carrier 290' with a cross-pin 420 to prevent the carrier extension 410 from sliding longitudinally or rotating with respect the modified bolt carrier 290'. The coupler 435 is wider than the stem 415 and has a diameter equal to the diameter of the rear end of the modified bolt carrier 290'. Once fixed within the modified bolt carrier 290' with the cross-pin 420, the carrier extension 410 is considered part of the modified bolt carrier 290' for the purposes of this disclosure. For example, with reference to FIG. 8, the free end of the coupler 435 which is positioned adjacent the buffer 190 provides the carrier end surface 290*b* discussed above. With continued reference to FIG. 8, the coupler 435 is structurally identical to the carrier interlock feature 320. The buffer 190 and buffer interlock feature 310 are identical to the original version described above.

It will be appreciated that the carrier extension 410 is a solid mass constructed of a more dense material than standard carrier material. For example, standard carrier material may be 8620 carbon steel while the carrier extension 410 may be constructed of machinable Tungsten. A majority of the piston driven versions of the AR15 use heavier buffers, carrier groups and even stiffer action springs to slow the reciprocating mass. Fitting the modified bolt carrier 290' with a more dense (and consequently more massive and heavy) carrier extension 410 makes the construction suitable for piston driven systems and compensates for material removed from the above-described bolt carrier 290 for forming the carrier interlock feature 320. It is also noteworthy that in the original version explained above as well as in this first variation and the other variations discussed herein, the buffer body may be constructed of materials other than traditional aluminum to increase mass of the reciprocating components. Alternative materials for the buffer body may include carbon and stainless steel, tungsten, and other dense, machinable materials.

Figure 9:
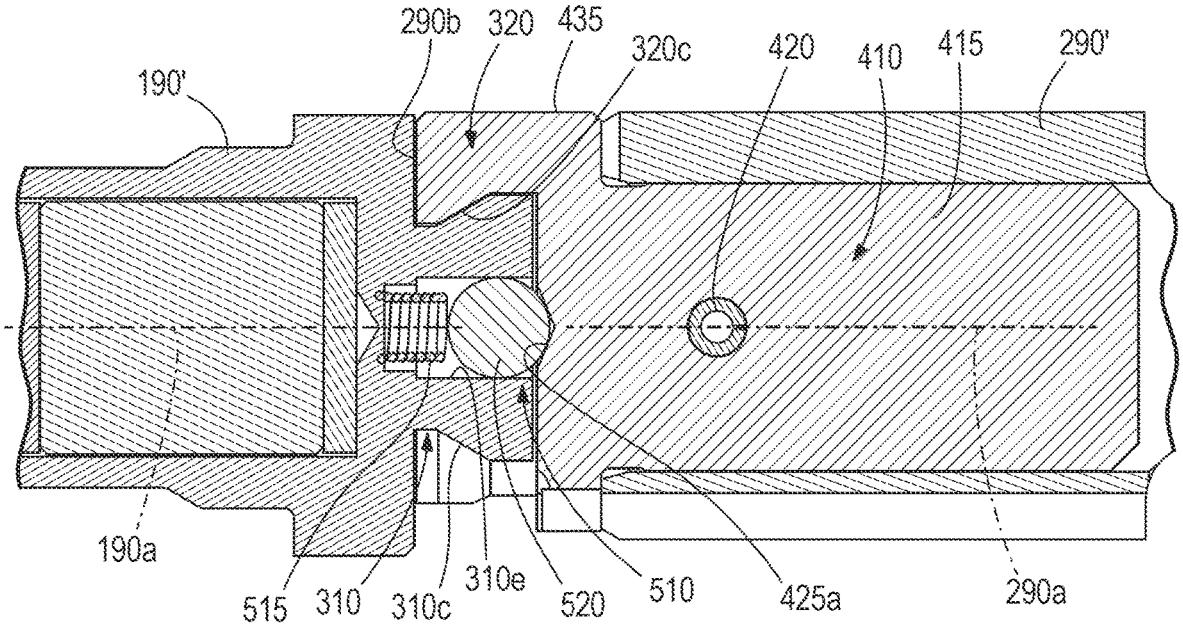
FIG. 9 is a cross-sectional view of a third configuration of the invention.

FIG. 9 illustrates a third version of the mechanical coupling 300 which is a variation on the version of FIG. 8, using a modified buffer 190' having a longitudinal bore 310*e* in the bolt interlocking feature 310. A detent mechanism 510 comprising a detent spring 515 and detent ball 520 are positioned in the longitudinal bore 310*e*. The detent spring 515 is deflected when the modified buffer 190' is mechanically coupled to the modified carrier 290' so that the detent spring 515 pushes the detent ball 520 against the carrier extension 410. The carrier extension 410 is modified with a detent pocket 410*a* into which the ball 520 is biased by the detent spring 515. The detent spring 515, detent ball 520, and detent pocket 410*a* are aligned along the buffer axis 190*a*. The biasing force of the detent spring 515 acts through the detent ball 520 along the buffer axis 190*a*. The action of the ball 520 being biased into the detent pocket 410*a* centers and axially aligns (i.e., makes the buffer axis 190*a* and carrier axis 290*a* collinear) the modified buffer 190' with respect to the modified bolt carrier 290'. The detent mechanism 510 (detent spring 515, detent ball 520) is made effective due to the mechanical coupling of the modified buffer 190' and modified bolt carrier 290' because of the elimination of buffer bounce. In a system with buffer bounce, the detent mechanism 510 would not be effective. Additionally, the detent mechanism 510 biases the modified buffer 190' and modified bolt carrier 290' away from each other to remove play between the bolt interlocking feature 310 and the carrier interlocking feature 320. More specifically, the detent mechanism 510 biases the shoulder 310*c* into engagement with the bearing surface 320*c*.

Figure 10:
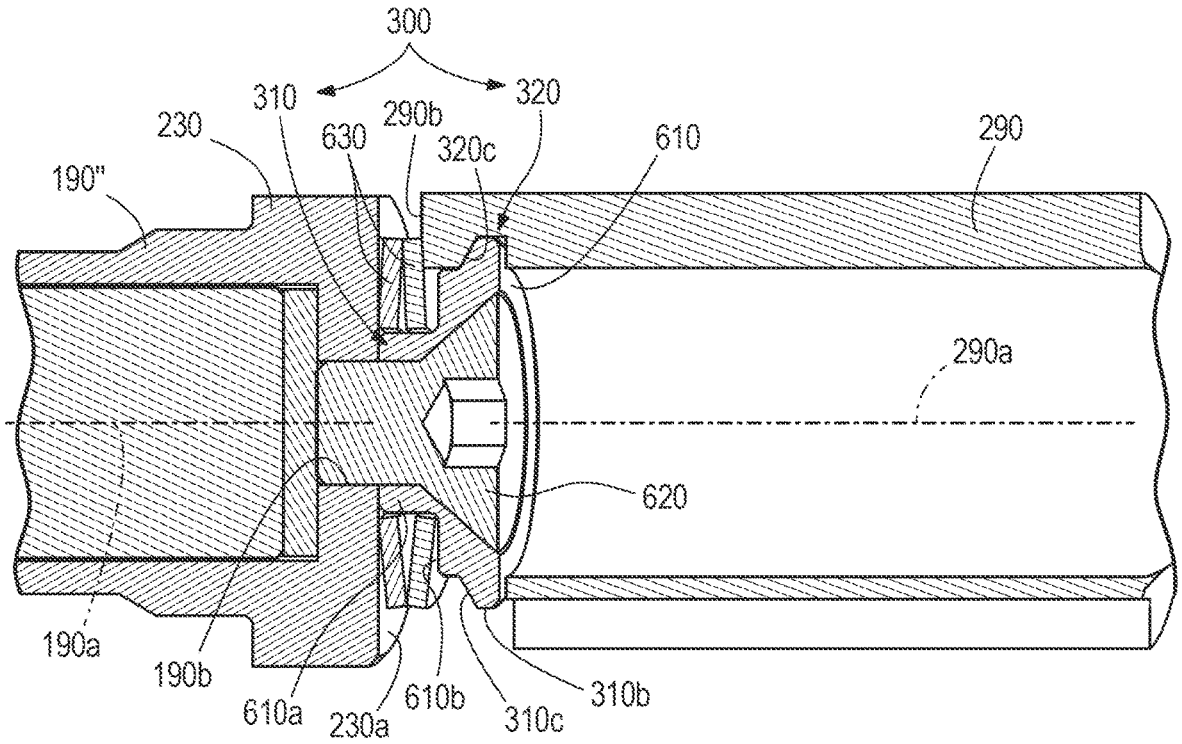
FIG. 10 is a cross-sectional view of a fourth configuration of the invention.

FIG. 10 illustrates a fourth version of the mechanical coupling 300 for use with another modified buffer 190" and the original bolt carrier 290 (or a slightly modified version of the bolt carrier 290 depending on specific dimensions employed). The modified buffer 190" is a traditional buffer having a threaded hole 190*b* in the end cap 230 centered on the buffer axis 190*a*. A bolt extension 610 that is separate from the modified buffer 190' provides the buffer interlock feature 310 in this embodiment. The bolt extension 610 includes identical button head 310*b* and shoulder 310*c* features to the buffer interlock feature 310 of the first embodiment, but its neck 610*a* is longer (extends further along the longitudinal axis 190*a*) than the neck 310*a* of the buffer interlock 310 feature discussed above. The bolt extension 610 is secured to the modified buffer 190' by way of a fastener 620 extending through the bolt extension and threaded into the threaded hole 190*b*. The longer neck 610*a* of this embodiment permits a pair of Bellville washers 630 to be trapped between a rearwardly-facing surface 610*b* of the bolt extension 610 and the buffer cap surface 230*a*. When assembled, the carrier end surface 290*a* abuts one of the Bellville washers 630 and the other Bellville washer 630 abuts the buffer cap surface 230*a*. The Bellville washers 630 are deflected during assembly and push against each other to bias the carrier 290 and modified buffer 190" away from each other. This biasing force removes play between the bolt interlocking feature 310 and the carrier interlocking feature 320. More specifically, the biasing force of the Bellville washers 630 biases the shoulder 310*c* into engagement with the bearing surface 320*c*.

Figure 11:
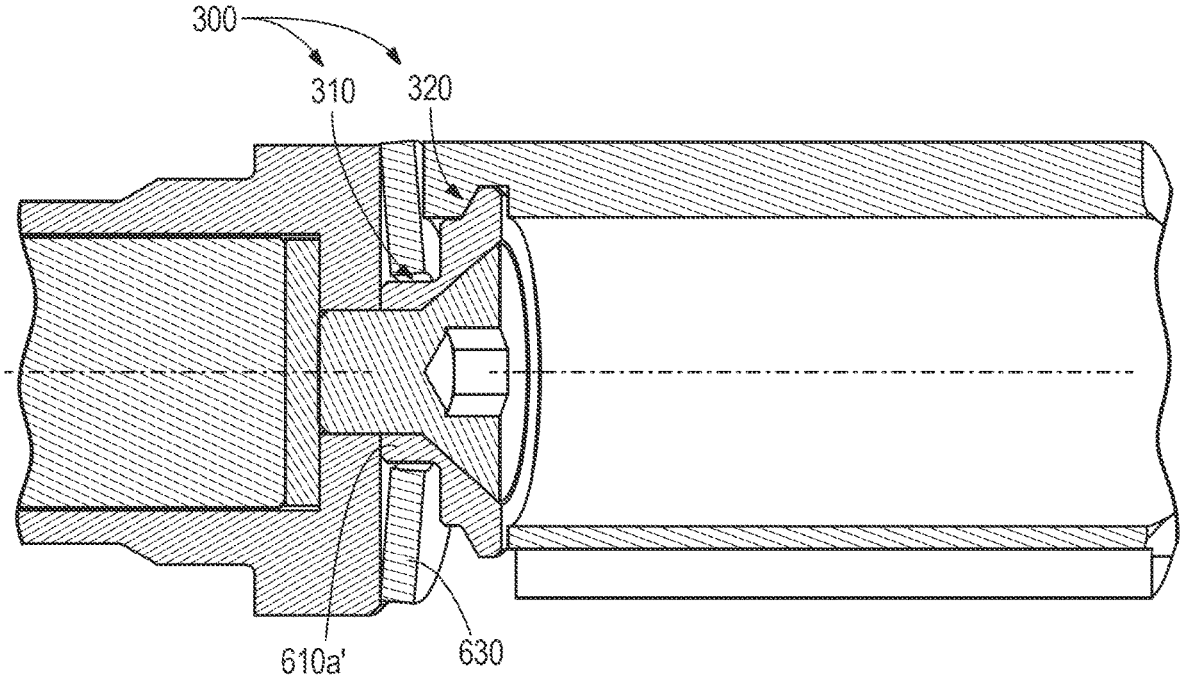
FIG. 11 is a cross-sectional view of a fifth configuration of the invention.

FIG. 11 illustrates a fifth version of the mechanical coupling 300 for use with the modified buffer 190" and the original bolt carrier 290. This embodiment is identical in all respects to the fourth version illustrated in FIG. 10, except that a single Bellville washer 630 is employed and the neck 610*a'* is modified to be of an appropriate length for the single Bellville washer 630. The single Bellville washer 630 serves the same purpose as the two Bellville washers 630 of the fourth version, albeit with a lower biasing force.

Thus, the invention provides, among other things, a mechanically coupled buffer and carrier to reduce, minimize, or eliminate carrier tilt and buffer bounce.

Various features and advantages of the invention are set forth in the following claims.

What is claimed is:

1. A bolt carrier and buffer assembly comprising:

a bolt carrier having a carrier interlocking feature; and a buffer having a buffer interlocking feature that mates with the carrier interlocking feature to form a carrier-buffer assembly;

wherein the carrier-buffer assembly defines a longitudinal axis; and wherein mating the buffer interlocking feature with the carrier interlocking feature prevents relative longitudinal movement between the bolt carrier and the buffer, wherein the carrier interlocking feature includes a non-longitudinal opening through which the buffer interlocking feature is moved to mate the buffer interlocking feature with the carrier interlocking feature.

2. The bolt carrier and buffer assembly of claim 1, wherein the bolt carrier interlocking feature includes an internal undercut groove, a bearing surface, and a throat.

3. The bolt carrier and buffer assembly of claim 2, wherein the buffer interlocking feature includes a button head, a shoulder, and neck.

4. The bolt carrier and buffer assembly of claim 3, wherein the buffer interlocking feature is configured to mate with the carrier interlocking feature by positioning the button head in the undercut groove such that the shoulder and bearing surface engage each other to prevent the relative longitudinal movement.

5. The bolt carrier and buffer assembly of claim 3, wherein the neck is configured to extend through the throat when the button head is positioned in the undercut groove.

6. The bolt carrier and buffer assembly of claim 2, wherein the bearing surface is beveled at a bearing angle.

7. The bolt carrier and buffer assembly of claim 6, wherein the shoulder is beveled at the bearing angle.

8. The bolt carrier and buffer assembly of claim 1, wherein the non-longitudinal opening is a radial opening with respect to the longitudinal axis.

9. A firearm comprising:

an upper receiver;

a buttstock coupled to the upper receiver;

a bolt carrier received for reciprocating motion in the upper receiver, the bolt carrier including a carrier interlocking feature; and a buffer extending into the buttstock, the buffer including a buffer interlocking feature configured to mate with the carrier interlocking feature to form a carrier-buffer assembly;

wherein the carrier-buffer assembly defines a longitudinal axis;

wherein mating the buffer interlocking feature with the carrier interlocking feature prevents relative longitudinal movement between the bolt carrier and the buffer, and wherein disengaging the buffer interlocking feature and the carrier interlocking feature permits the bolt carrier and the buffer to be separated.

10. The firearm of claim 9, further comprising a buffer tube extending into the buttstock and an action spring received within the buffer tube, wherein the action spring is configured to bias the buffer in a forward direction along the longitudinal axis.

11. The firearm of claim 10, further comprising a buffer retaining pin engageable with the buffer to retain the buffer within the buffer tube against the bias of the action spring when the bolt carrier and the buffer are separated.

12. The firearm of claim 9, wherein the bolt carrier is pivotable relative to the buffer to mate the buffer interlocking feature with the carrier interlocking feature.

13. The firearm of claim 9, wherein the bolt carrier interlocking feature includes an internal undercut groove, a bearing surface, and a throat, and wherein the buffer interlocking feature includes a button head, a shoulder, and neck.

14. The firearm of claim 13, wherein the buffer interlocking feature is configured to mate with the carrier interlocking feature by positioning the button head in the undercut groove such that the shoulder and bearing surface engage each other to prevent the relative longitudinal movement.

15. The firearm of claim 14, wherein the neck is configured to extend through the throat when the button head is positioned in the undercut groove.

16. The firearm of claim 9, wherein the carrier interlocking feature includes a non-longitudinal opening through which the buffer interlocking feature is moved to mate the buffer interlocking feature with the carrier interlocking feature, and wherein the non-longitudinal opening is a radial opening with respect to the longitudinal axis.

17. The firearm of claim 9, wherein the bolt carrier includes a carrier body and a carrier extension fixed to the carrier body, and wherein the bolt carrier interlocking feature is provided on the carrier extension.

18. The firearm of claim 17, wherein the carrier extension and the carrier body are made of different materials having different densities.

19. A method of mechanically interlocking a buffer and a bolt carrier of a firearm having an upper receiver and a buttstock, the method comprising:

positioning the bolt carrier such that a carrier interlocking feature of the bolt carrier is at a rear end of the upper receiver;

pivoting the upper receiver relative to the buttstock to align a buffer interlocking feature at a front end of the buffer with the carrier interlocking feature; and moving a head of the buffer interlocking feature into a mouth of the carrier interlocking feature.

* * * * *